US007112073B2

(12) United States Patent
Morlok

(10) Patent No.: US 7,112,073 B2
(45) Date of Patent: Sep. 26, 2006

(54) ELECTRICAL CONNECTOR

(75) Inventor: Claus Morlok, Baiersbronn (DE)

(73) Assignee: ITW Morlock GmbH, Dornstetten (DE)

( * ) Notice: Subject to any disclaimer, the term of this patent is extended or adjusted under 35 U.S.C. 154(b) by 141 days.

(21) Appl. No.: 10/986,286

(22) Filed: Nov. 12, 2004

(65) Prior Publication Data

US 2005/0106899 A1 May 19, 2005

(30) Foreign Application Priority Data

Nov. 15, 2003 (DE) ..... 103 53 469

(51) Int. Cl.
*H01R 13/44* (2006.01)
*H01R 13/60* (2006.01)

(52) U.S. Cl. ..... 439/142; 439/521; 439/535; 174/50

(58) Field of Classification Search ..... 439/142, 439/535, 521, 76.2, 949; 174/50
See application file for complete search history.

(56) References Cited

U.S. PATENT DOCUMENTS 1,862,811 A * 6/1932 Strong ..... 174/59
5,795,176 A 8/1998 Blaetz
6,657,123 B1 * 12/2003 Moore ..... 174/50
6,721,184 B1 4/2004 Lehmeier et al.
2002/0070043 A1 * 6/2002 Kitajima ..... 174/50

FOREIGN PATENT DOCUMENTS

| | | |
|---|---|---|
| DE | 195 11 755 | 8/1996 |
| DE | 299 06 707 | 7/1999 |
| DE | 199 22 123 | 11/2000 |
| DE | 199 25 547 | 12/2000 |
| DE | 299 19 901 | 4/2001 |
| DE | 201 15 828 | 11/2002 |
| DE | 102 17 292 | 11/2003 |
| EP | 0 821 434 | 1/1998 |
| EP | 0 923 163 | 6/1999 |
| WO | WO 00/64012 | 10/2000 |

* cited by examiner

*Primary Examiner*—Tho D. Ta
(74) *Attorney, Agent, or Firm*—Lowe Hauptman & Berner, LLP

(57) ABSTRACT

Electrical connector, containing a casing; a multipolar connection unit, which forms a unit together with the casing; an interface, preferably an AS interface, designed as a slave, which is aligned within the casing; a bus connection appliance, which forms a unit together with the casing; and electrical connections within the casing through which the interface is connected on the one side with the bus connection appliance and on the other side transmitting signals with the connection unit.

15 Claims, 3 Drawing Sheets

ELECTRICAL CONNECTOR

RELATED APPLICATIONS

The present application is based on, and claims priority from, German Application No. 103 534 69.5, filed Nov. 15, 2003, the disclosure of which is hereby incorporated by reference herein in its entirety.

FIELD OF THE INVENTION

The invention concerns an electrical connector containing a casing and multipolar connection unit, which features a multiplicity of connecting elements from electricity-conducing material and a connection side, which is accessible from the exterior of the casing, meaning that a secondary connection unit with a multiplicity of secondary connecting elements from electricity-conducing material can be connected to the connection elements of the connection unit from the exterior of the casing.

BACKGROUND TO THE INVENTION

Connectors of the type outlined are well known for transmission of signals, whereby they transmit electrical currents and/or electrical circuits.

Interfaces are also well known, whereby they are designed as slaves and feature bus connections for connecting to a bus and signal connections from at least one signal input and/or one signal output. An interface here means a connecting part or adapting module. A slave is a unit, which is accessible from a superordinate unit, typically referred to as a master. Several slaves can be connected to a master, and therefore in this invention several interfaces may be connected either in parallel or in a row. In accordance with this, the interface contains bus connections for connecting a bus, which connects the slave with the master; and signal inputs and signal outputs, which feature signal connections for connecting electrical circuits, e.g. sensors, actuators, electrical appliances or machines—i.e. for the general connection of electrical circuits, which can either be controlled by the master via the slave of the interface and/or can give electrical signals to the master by means of the slave of the interface. Well known are, for example, so-called AS interfaces (AS-I), which are designed as slaves. With AS-I networks it is also possible to provide electricity to the electrical circuits from the bus via an AS interface.

AS interfaces (Actuator Sensor Interfaces) concern a network structure, which has been especially designed for the automation of the controlling of electrical circuits, like for example sensors or actuators. The electrical circuits are connected to the respective AS-I network via the appropriate AS interface slave combination. AS-I networks are also associated with a master, which for example sends commands to the slaves, monitors these slaves and receives signals from them. A master can, for example, be a PLC (programmable logic control), a PC (personal computer), a gateway to a superordinate fieldbus or an Ethernet. The AS-I bus, which connects the master to the slaves, is generally designed as a dual-conducing bus, and serves both to provide electrical current to the slaves and to transmit signals between the master and the slaves. Various network topologies are possible with an AS-I network, like for example a lineal, star or tree structure.

Each slave in an AS-I network has its own address, which can either be manually set or automatically set by a master. Four output Bits are, for example, used for the exchange of information between the master and the slaves in an AS-I network, in order to control the electrical circuits connected, such as to open an outlet or switch. In addition, four input Bits are, for example, available for the response of a slave to the master. The four input Bits and four output Bits can also be used for other functions however.

It is well known to build in one or more AS interfaces that are designed as AS-I slaves into a device cabinet, to connect a bus cable in an AS-I network to a bus connection in an interface, and to connect the signal connections and electricity-conducing connections of the interface with a connection unit, which is attached to a control cabinet and has a connecting side on the exterior control cabinet side for connecting to a secondary connection unit, which is connected or able to be connected with an external electrical circuit via a cable. The use of control cabinets is expensive, requires time-consuming and expensive installation work and requires a lot of storage room, which is often not available. Control cabinets can then only be used in tough surroundings, in which dust and water accumulates if they are particularly stably run and expensively sealed.

In addition, there are also interfaces designed as slaves for AS-I networks, which are moulded into a synthetic block made of electricity-insulating material and feature bus connections and signal connections separated from one another on the exterior side of the slab, meaning that a number of connectors and plugs are required. Generally a connection or plug will be used for each input or output, which makes the provision of electricity, gages and signal for the sensor or actuator available (e.g. tripolar).

AS-I interfaces are more intelligent wiring systems than a real fieldbuses. With this type of interface designed as an AS-I slave simple sensors and actuators can be wired very cheaply via an AS-I bus, which contains one or more, preferably two electrical conductors (dual-conducing bus), including the provision of voltage. Each individual signal provider and signal receiver is wired directly with a superposed control system in a traditional wiring system. Sprawling bundles of cables and voluminous control cabinets are the result. Cable and installation costs can be reduced as a result. The upwardly open structure of the AS interface system means that it is not competition for superordinate fieldbuses, but rather a technical and financial supplement. The interface slave system offers advantageous solutions for the large product spectrum in many companies for the integration of different sensors and actuators for almost all automation purposes.

The interface, designed as an AS-I slave, is a module with inputs and outputs for connection with signal providers and actuators.

With devices and specialist machines it is again and again the case that additional machines, devices and fixtures are attached, which are internally controlled. Often few outputs and inputs are required to control these units. This can be made possible in a functional way with an AS interface bus. The following conditions are necessary for this: Inputs into the interface, which are potentially separate from the bus, and/or interface outputs, which are potentially separate from the bus (separate electrical potentials). The outputs and/or inputs contain, for example, a relay or an optocoupler.

The well known interface slaves, which have potentially separate inputs or outputs, are modules, which are designed for the installation of control cabinets. These modules must be installed into control cabinets or other casing, so that they are protected from environmental influences. The modules must also be wired, on the one hand to the bus and on the other hand the inputs and outputs to the respective electrical circuit, for example a sensor, another device or a machine. If a connector is desirable at the control cabinet this must be mounted on a wall of the control cabinet and connected via electrical wiring with the module.

BRIEF DESCRIPTION OF THE INVENTION

The invention is designed to reduce the material and time involved in installation with the use of interface slave modules and AS interface modules in particular. In addition, this should preferably be achieved in such a way that the interface slave module can also be used in the field in tough environmental conditions such as dusty or damp surroundings. The term field here refers to the usage of such a module at the place where the device, machine, facility or any other electrical circuit to be controlled or monitored is situated.

This task is achieved in accordance with the invention by means of the criteria in claim 1.

Accordingly the invention will be resolved with an electrical connector, containing a casing, which is designed to be mounted onto a bracket; a multipolar connection unit, which features a multiplicity of connecting elements from electricity-conducing material and a connecting side accessible from the exterior of the casing, meaning that a secondary connection unit with a multiplicity of electricity-conducing material can be connected to the connection elements of the connection unit from the exterior of the casing, characterized by the fact that at least one interface is aligned inside the casing, which is designed as a slave and features bus connections for connecting the electrical wires of a bus and signal connections from at least one signal input and/or at least signal output; that a bus connection device is attached to the casing, which features bus connection elements made out of electricity-conducing material that are accessible from the exterior of the casing, for connecting the electrical wire from outside of the casing; that bus connection elements in the bus connection device inside the casing are connected electrically with the bus connections of the interface; that the signal connections of the interface within the casing are connected electrically with the connecting elements of the connection unit.

SUMMARY OF THE INVENTION

The invention provides a unit, which features a multipolar connection and an interface slave together in one casing, whereby potentially separate inputs and outputs are provided for. Reduction of installation costs and time. No installation work at the place of application (field) necessary, as all inputs and outputs of the interface slave module are connected to the connection unit and therefore only a one secondary connection unit can be attached to the connection unit with one single cable (or very few cables each with several conductors), in order to connect an electrical circuit, for example a sensor, a device, a machine or a facility with an interface slave module. No installation needs to be carried out with the connection of the bus to the interface slave module either, but rather a bus connection, e.g. an AS interface bus, alone needs to be connected to a bus connection appliance on the exterior side of the casing. The casing therefore does not need to be opened for this purpose. The bus connection appliance can be wired in with the interface slave module inside the casing, which forms the connector. The connector consists of a casing, a connection unit and a bus connection appliance, as well as the electrical connections of the module to the bus connection appliance on the one side and to the connection unit on the other side.

The casing can either be "free-standing" (without means for attachment) or with casing (mounted casing) for means for attachment, e.g. provided with holes, slits, pre-formed opening to be prised open, brackets, bolts or screws to attach onto a mount, e.g. onto a wall. The wall can either be the wall of a building, the structure of a machine or the housing of a device or machine.

The casing means that the interface slave module (an interface slave connection unit) ensures protection against environmental influences such as interference from objects, sand and dust. The casing is preferably closed on all sides, with the exception of a casing opening, onto which the bus connection appliance is fixed. The bus connection appliance is preferably sealed against the casing with a seal or the effusion of the casing with an electrically isolating mould, so that the casing is designed to be dustproof and preferably waterproof for weaker and stronger water pressures. Another casing opening on or to which the connection unit is attached on or to the casing, can be closed by means of the connection unit or by means of lid for the selective covering and uncovering of a connecting side of the connection unit, which is accessible from the exterior of the casing. The connector can therefore be used in tough surroundings. In addition, if the casing is made out of metal then protection from electrical interferences into the interior of the casing or from the casing to external electrical appliances is ensured.

DETAILED DESCRIPTION OF THE INVENTION

The invention will be described from now on with reference to the appended diagrams on the basis of preferred forms of usage. The diagrams show

Figure 1:
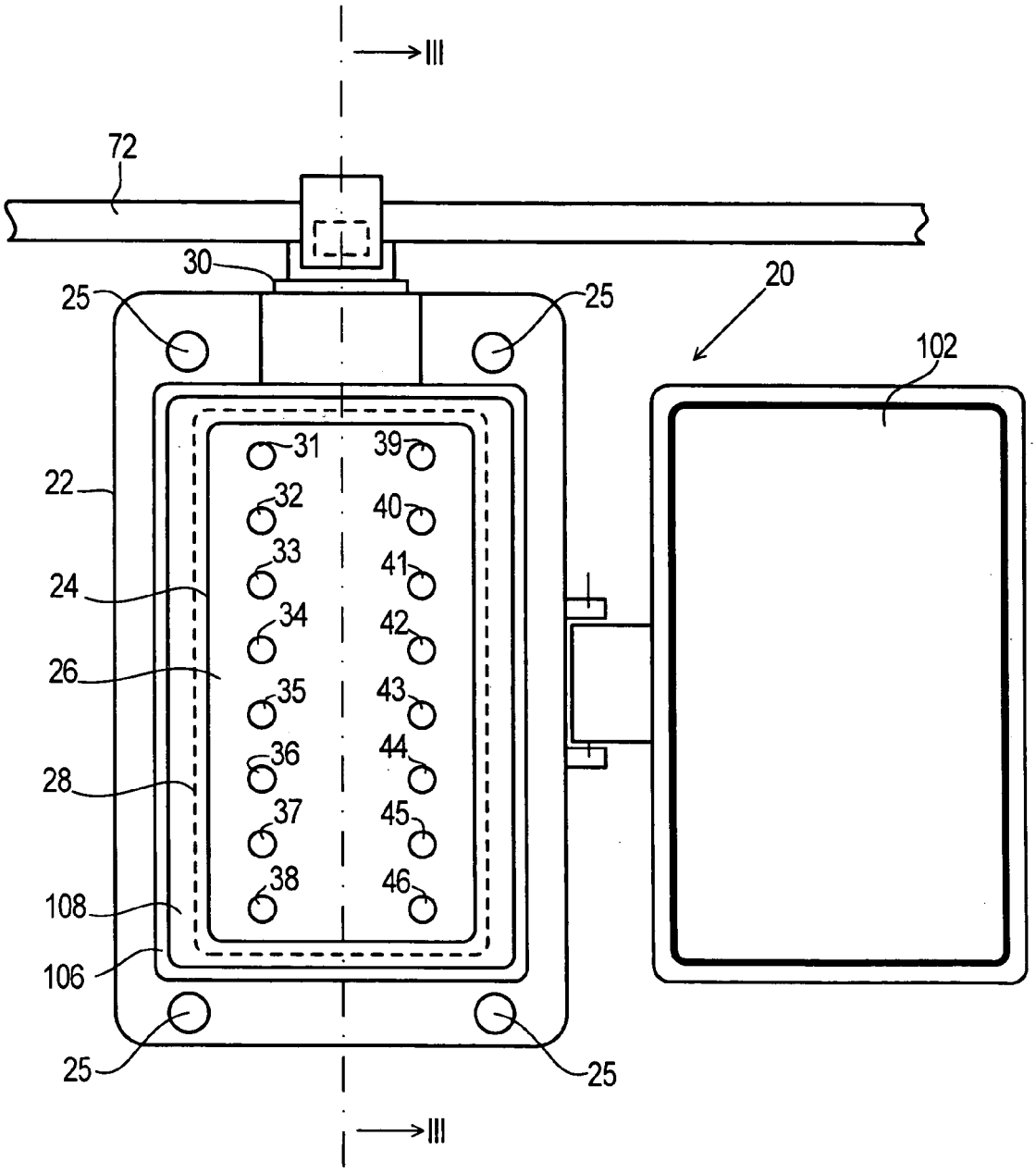
FIG. 1 a schematic frontal view of an electrical connector in accordance with the invention with a lid in an open position.

The electrical connector 20 schematic shown in a frontal view in FIG. 1 is in accordance with the invention a mechanical unit (module), which consists of a casing 22 and the elements connected with this casing 22. These elements are a multipolar connection unit 24, whose connecting side 26 is apparent in the frontal view of FIG. 1, an interface 28 which is aligned behind the connection unit 24 in the casing 22, which is designed as a slave, a bus connection appliance 30 and electrical connections between the interface 28 and the bus connection appliance 30 as well as between the interface 28 and the connection unit 24. The interface 28 is preferably an AS interface slave (AS=Actuator Sensor). The casing 22 can be a casing either without or preferably with means for affixing, e.g. holes 25, which will preferably be formed by the piercing of pre-formed casing parts. The casing 22 can therefore be affixed to a mount, e.g. to the wall of a building, the structure of a machine, or the housing of an appliance or a machine.

The connection unit 24 contains a number of connecting elements 31 to 46, which are each electrically connected in accordance with the desired connector assignment plan (see for example FIG. 2) with one of e.g. 16 signal connections 1 to 16 of the interface 28 by means of electrical wires 29. Two signal connections 1,9 or 2,10 or 3,11 or 4 are each aligned with a signal output 1/9 or 2/10 or 3/11 or 4/12; and each two signal connections 5,13 or 6,14 or 7,15 or 8,16 are aligned with a signal input 5/13 or 6/14 or 7/15 or 8/16 of the interface 28, whereby FIG. 3 solely shows an example of such a circuit.

According to the type of implementation an electrical current from Bus 72 to the interface 28 or from the connection unit 24 to the interface 24 can be provided for, preferably by means of at least one of the signal inputs and/or signal outputs, e.g. the signal outputs 1/9, 2/10, 3/11 or 4/12.

The connecting side 26 of the connection unit 24 is accessible from the exterior of the casing 22, so that a secondary connection unit 50 is connectable with a multiplicity (preferably with the same number as the connecting elements 31 to 46) of secondary connecting elements 51 to 66 from the exterior of the casing 22 into the connecting elements 31 to 46 of the connection unit 24 of the electrical connector 20 with a single connecting motion by one person. The connecting elements in FIG. 3, which are covered with visible connecting elements and therefore not visible, are referred to with numbers in brackets. All secondary connecting elements 51 to 66 are connected to one of an appropriate number of electrical wires 68 of a single cable 70 or of a few cables and therefore each able to be connected by means of the connecting elements 31 to 46 of the connection unit 24 with a signal connection of the signal connections 1 to 16 of the interface 28, whereby only the secondary connection unit and the connection unit 24 need to be connected.

Figure 2:
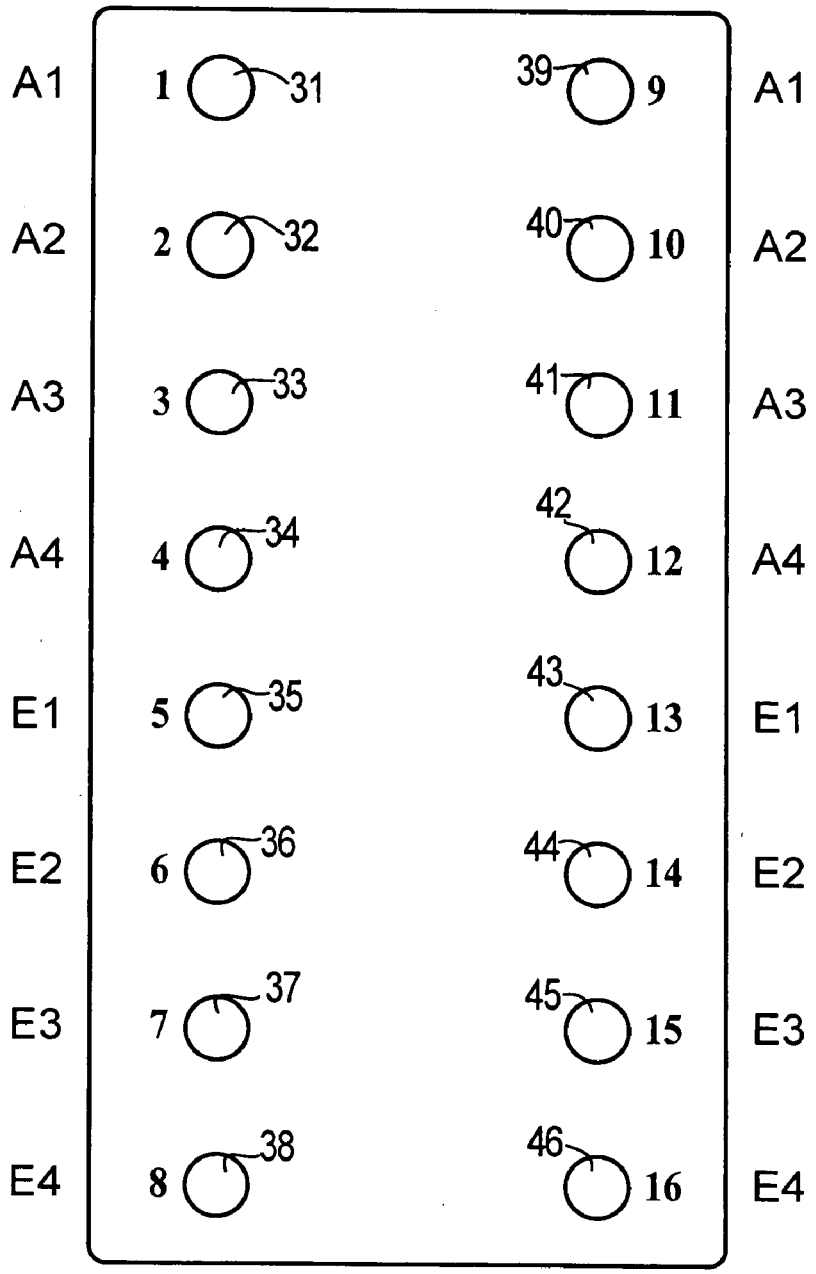
FIG. 2 an example of a connector assignment plan using a schematic frontal view of FIG. 1, whereby connecting elements are numbered in accordance with a connector assignment plan from a number of possible connection units, whereby the connector assignment plan shows which connecting elements of the connection unit are electrically connected to which signal connections of an interface of the connector.

FIGS. 1 and 2 show an implementation form of the invention where the connecting elements 31 to 46 connectors are, in which the connecting elements 51 to 66 designed as connecting bolts can be connected to the secondary connection unit. In accordance with an implementation form of the invention not shown these connecting elements can also be interchanged so that the connection unit 24 of the connector 20 are connecting bolts and the connecting elements 51 to 66 of the secondary connection unit 50 are connecting bolts. The connecting elements each form electrical connections with each other. A combination of bolts is also possible, in order to for example codify the connector, i.e. make it free of confusion.

The interface 28 is designed as a slave, preferably as an AS interface slave, in order to receive signals from a master via a bus 72, preferably an AS-I bus, and independently of this to control an electrical circuit which is connected to the electrical wire 68 of the cable 70, or inform the master in accordance with the same or another implementation form of this electrical circuit of signals via the interface, or in accordance with other implementation forms only to inform of signals from the master via the interface of the electrical circuit.

Figure 3:
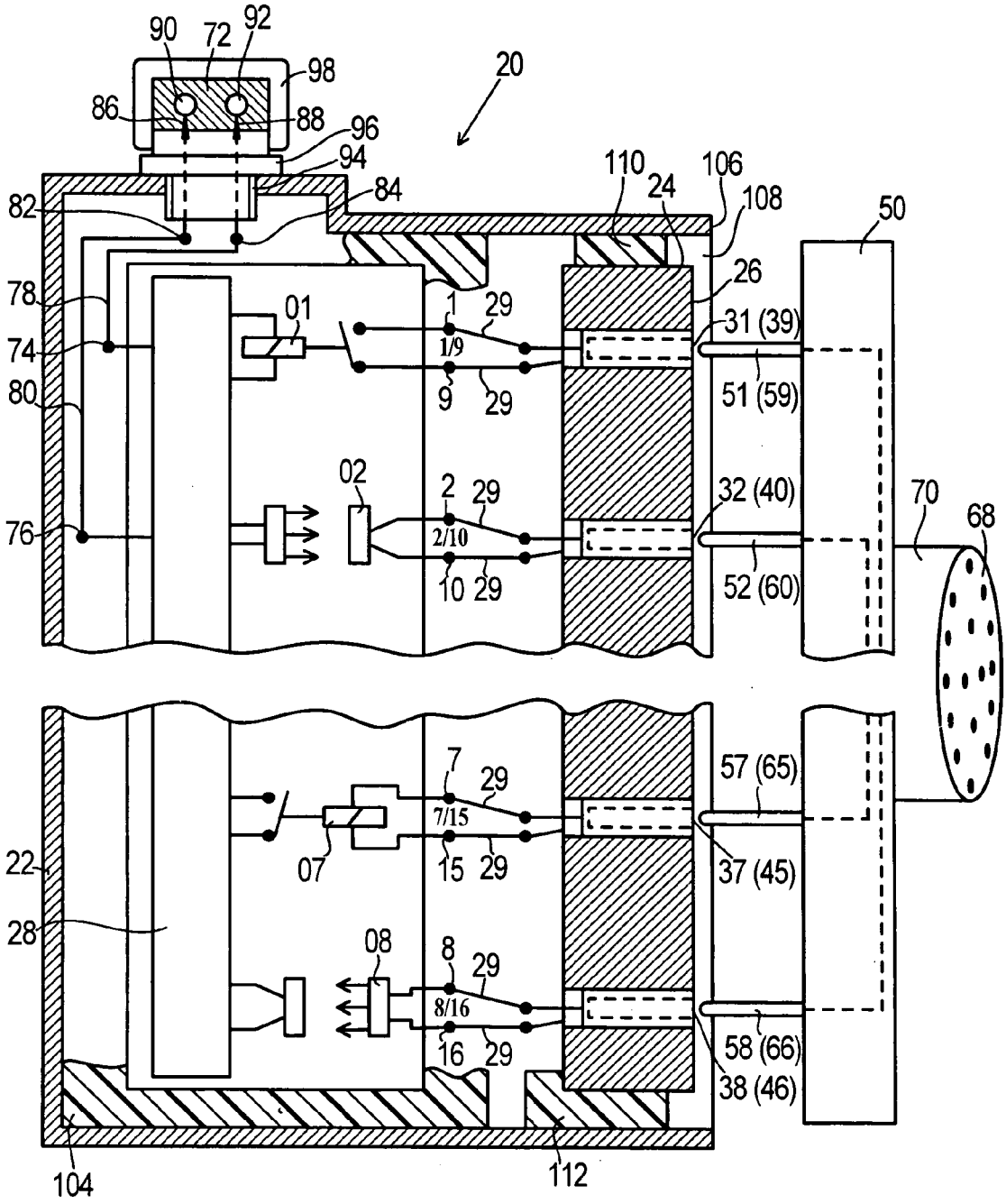
FIG. 3 a schematic and exploded cross-sectional view (not to scale), approximately on the level III—III from FIG. 1 with another connector assignment (other connections between the connection unit and the interface) than in FIG. 2.

As FIG. 3 schematically portrays, at least some of the signal outputs, e.g. 1/9, 2/10 and/or some of the signal inputs, e.g. 7/13 and 8/16 are separate from the bus 72 in terms of electrical potentials, where they are potentially separate from interface bus connection elements e.g. 74 and 76, of the interface 24. These interface bus connection elements 74 and 76 are made of electrically-conducing material and are connected via electrical wires 78 and 80 within the casing 22 to bus connection elements 82 or 84 or the bus connection appliance 30.

The bus connecting elements 82 and 84 of the bus connection appliance 30 are situated on the exterior side of the bus connection appliance 30, which is also on the exterior side of the casing 22, designed as penetrating elements 86 or 88 or connected to such external penetrating elements 86, 88, which are attachable into electrical isolation of the bus 72 up to contacting of an electrical wire 90 or 92 of the bus 72. The number of electrical wires 90, 92 of the bus 72 is dependent on the configuration of the entire network. The bus 72 can contain more or less than two electrical wires 90, 92 according to the purpose of usage.

The bus connection appliance 30 contains a basic part 96 which is affixed to the casing 22, preferably screwed into a thread 94 in the casing 22, from which the penetrating elements 86 and 88 jut out, and a hood 98, which can be connected to a part of the basis 96 jutting out of the casing 22, in order to shut the bus 72 in between itself and the basic part 96, and to hold its electrical wires 90 and 92 in contact with the penetrating elements 86 and 88. The hood 98 can be affixed to the basic part 96 in various ways, for example by screwing it on or preferably attaching these two parts with the help of a rest or screw thread.

A lid 102 is preferably provided for, with which the connecting side 26 of the connection unit 24 or preferably the entire casing opening of the casing 22, in which the connection unit 24 is aligned, can be closed or opened at will. The lid 102 can be a separate part or preferably pivoted on the connection unit 24 or even better on the casing 22 as shown in FIG. 1, so that it can move between a closed position and the open position as shown in FIG. 1.

The casing 22 and the lid 102 in the case that a lid is employed, are preferably made of metal so that the inside of the casing 22 is electro-magnetically shielded from the exterior surroundings.

With the implementation form of FIG. 3 there are signal connections 1 and 9 of an interface output 1/9, for example circuit contacts of a rely 01 of the interface 28, each electrically connected inside the casing 22 via electrical wires with one of the connecting elements 31 and 39 of the connection unit 24. The signal connections 2 and 10 of the output 2/10, e.g. the receiver 02 of an optocoupler of the interface 28, are each electrically connected via the electrical wires 29 within the casing 22 with one of the two connecting elements 2 or 10 of the connection unit 24. The signal connections 7 and 15 of the input 7/15, e.g. of a relay 07 of the interface 28, are each electrically connected within the case 22 via electrical wires 29 with one of the two connecting elements 37 or 45 of the connection unit 24. The signal connections 8 and 16 of the input 8/16, e.g. of the sender 08 of an optocoupler of the interface 28, are each electrically connected via electrical wires 29 within the casing 22 with a connecting element 38 or 46 of the connection unit 24.

The interface shown in FIG. 3 is wired according to another assignment plan to that of the connection unit 24 shown in FIG. 2. The following situation is portrayed in FIG. 2: the interface 28 has an output A1 with signal connections 1 and 9 e.g. in the form of relay contacts; an output A2 with signal connections 2 and 10 e.g. in the form of relay contacts, an output A3 with signal connections 3 and 11 e.g. as outputs of a semiconductor component; an output A4 with signal connections 4 and 12 e.g. in the form of as outputs of a semiconductor component; an input E2 with signal connections 5 and 13 for example as electricity-conducing connections, for example 24 V direct voltage; an input E2 with signal connections 6 and 14 for example for gages and a semiconductor output; an input E3 with signal connections 7 and 15 at free disposal, for example for the connection of a positive potential; and an input E4 with signal connections 8 and 16 at free disposal for example for the connection of a positive potential. Within the casing 22 here the signal connection 1 for the output A1 is connected with the connecting element 31, and the signal connection 9 is electrically connected with the connecting element 39 of the connection unit 24; the signal connection 3 from the output A3 is electrically connected with the connecting element 33 and the signal connection 11 is electrically connected with the connecting element 41, from the output A4 the signal connection 4 is electrically connected with the connecting element 34 and the signal connection 12 is electrically connected with the connecting element 42; from the input El the signal connection 5 (or the electricity-conducing connection 5) is electrically connected with the connecting element 35 and the signal connection 43 is electrically connected with the connection unit 24; from the input E2 the signal connection 6 (or gage connection 6 or semiconductor output 6) is electrically connected with the connecting element 36 and the signal connection 14 (or gage connection 6 or semiconductor output 6) is electrically connected with the connecting element 44 of the connection unit 24; from the output E3 the signal connection 7 is connected with the connecting element 37 and the signal connection 15 is electrically connected with the connecting element 45 of the connection unit 24; from the output E4 the signal connection 8 is electrically connected with the signal connection 38 and the signal connection 16 is electrically connected with the connection element 46 of the connection unit. The input E1 with the signal connections 5 and 11 serves e.g. to provide electricity e.g. 24 V voltage, to a part of the interface 28. The input E2 with the signal connections 6 and 14 serves for example as a gage or semiconductor.

Of course other connecting alignments are also possible.

The interface 28, which is designed as an AS-I slave as a potentially separate relaying element between the master and an electrical circuit, is preferably dustproof in the casing 22, preferably waterproof, or designed for a predetermined water pressure, preferably against a spray of water with a certain water pressure.

The interface 28 is preferably moulded into the casing 22 in a gage 104 made from electrically insulated material. The moulding gage 104 is portrayed in an exploded view in FIG. 3.

In addition or instead of the moulding gage 104 the lid 102 can be aligned so that the rim 106 of the casing opening 108 in which the connection unit 24 is aligned, is dustproof and preferably waterproof when the lid is closed. In addition or instead, the connection unit 24 is sealed into the casing 22, for example with a seal 110, or by pouring the connection unit 24 in the casing 22 into a moulding gage 112. The moulding age 112 can be the same as the moulding gage 104. The interface 28 and the connection unit 24 can be poured into the moulding gage 104 or 112 either separately or together.

The interface (28) slave is located in the casing 22, the connection unit 24 can be aligned on the casing 22 or preferably in the casing 22; the bus connection appliance 30 is affixed to the wall of the casing 22 in such a way that the casing 22 is waterproof at this point and a bus 72 on the exterior of the casing 22 can be connected to the bus connection appliance 30; whereby all electrical connections from the interface (28) slave are on the one side aligned to the bus connection appliance 30 and on the other side to the connection unit 24 on the inside the casing 22, and the exterior of the casing 22 is waterproof sealed, or at least protected against water with a low pressure.

The invention claimed is:

1. An electrical connector containing a casing; a multipolar connection unit, which features a multiplicity of connecting elements from electricity-conducing material and a connection side, which is accessible from the exterior of the casing, meaning that a secondary connection unit with a multiplicity of secondary connecting elements from electricity-conducing material can be connected to the connecting elements of the multipolar connection unit from the exterior of the casing; wherein inside the casing at least one interface is located, which is designed as a slave and features bus connections for connecting of electrical wires of a bus and signal connections from at least one signal input and/or at least one signal output;

a bus connection appliance is affixed to the casing, which features bus connection elements from electrically-conducing material which are accessible from the exterior of the casing, to connect the electric wires of the bus outside of the casing;

the bus connection elements of the bus connection appliance are electrically connected inside the casing with the bus connections of the interface; and that the signal connections of the interface within the casing are electrically connected with the connecting elements of the multipolar connection unit; whereby the casing forms a mechanical unit together with the connection unit and the interface.

2. Connector in accordance with claim 1, wherein at least one bus connection of the interface is separate from at least one signal connection of the interface with respect to electrical potentials.

3. Connector in accordance with claim 1, wherein the interface is designed to be dustproof and/or aligned in the casing and hence protected from dust.

4. Connector in accordance with claim 1, wherein the interface in the casing is poured in to an electrically insulating mould, preferably a synthetic mould, and is therefore dustproof.

5. Connector in accordance with claim 1, wherein the interface is designed to be waterproof and/or aligned in a casing and hence waterproof, at least against sprays of water.

6. Connector in accordance with claim 1, wherein the connection unit is aligned in an opening of the casing.

7. Connector in accordance with claim 1, wherein the bus connection elements of the bus connection appliance feature penetrating elements on the exterior side of the casting or are electrically connected with such external penetrating elements, which are grooved into the electrically insulating shell of the bus in order to contact an electrical wire of the bus.

8. Connector in accordance with claim 1, wherein the casing is made of metal.

9. Connector in accordance with claim 1, wherein the lid is made of metal.

10. Connector in accordance with claim 1, wherein the interface features at least two, preferably three or four signal inputs and/or at least two, preferably three or four signal output, whereby each signal input or signal output features at least one of the signal connections.

11. Connector in accordance with claim 1, wherein the interface is an AS interface for an AS-I bus.

12. Connector in accordance with claim 1, wherein at least one input and/or one output of the interface is designed for the provision of electricity from one part of the interface.

13. Connector in accordance with claim 1, wherein the casing features means of affixation to a mount.

14. Connector in accordance with claim 1, wherein a lid is provided for, which is adjustable between an open position in which it releases the connecting side of the connection unit and a closed position in which the connecting side, preferably the entire connection unit is covered and is dustproof, preferably waterproof and at least protected from sprays of water.

15. Connector in accordance with claim 14, wherein the lid on the connection unit or preferably on the casing is pivoted.

* * * * *